United States Patent [19]

Fujimoto

[11] Patent Number: 4,543,161

[45] Date of Patent: Sep. 24, 1985

[54] DOUBLE CYLINDER PRESS FOR FORMATION OF FIBROUS LAYERS

[76] Inventor: Shigeo Fujimoto, 3984-24, Imaizumi, Fuji-shi, Shizuoka-ken, Japan

[21] Appl. No.: 638,714

[22] Filed: Aug. 8, 1984

[30] Foreign Application Priority Data

Aug. 9, 1983 [JP] Japan ..... 58-122838
May 17, 1984 [JP] Japan ..... 59-71094

[51] Int. Cl.[4] ..... D21F 1/60; B30B 9/20; D21D 5/06

[52] U.S. Cl. ..... 162/323; 100/121; 162/328; 162/331; 162/335; 210/326

[58] Field of Search ..... 162/323–335; 100/121; 210/326, 402

[56] References Cited

U.S. PATENT DOCUMENTS 3,730,079 5/1973 Stirk et al. ..... 100/121
3,772,144 11/1973 Luthi et al. ..... 162/329 X

FOREIGN PATENT DOCUMENTS 18877 8/1882 Fed. Rep. of Germany ..... 100/121
115883 12/1876 France ..... 100/121
52-10741 3/1977 Japan .
2016549 9/1979 United Kingdom ..... 162/335
589315 1/1978 U.S.S.R. ..... 210/326

*Primary Examiner*—S. Leon Bashore
*Assistant Examiner*—Karen M. Hastings
*Attorney, Agent, or Firm*—Wenderoth, Lind & Ponack

[57] ABSTRACT

A double cylinder press for the formation of fibrous layers is capable of extracting fibers from fiber-containing liquid, causing the fibers to be adsorbed on the surfaces of wire gauzes 41 of cage cylinders 40 disposed in a stationary butt 10 and a swing butt 12, allowing masses of fibers produced in the course of the formation of fibrous layers to spontaneously drop down from above a region in which the cage cylinders are brought into pressure contact with each other to be collected, and allowing waste liquid resulting from compression and dehydration of the fibers to be dropped and discharged out of the double cylinder press with high efficiency.

15 Claims, 8 Drawing Figures

DOUBLE CYLINDER PRESS FOR FORMATION OF FIBROUS LAYERS

BACKGROUND OF THE INVENTION

1. Field of the Invention

The present invention relates to a double cylinder press for the formation of fibrous layers from fiber-containing liquid such as pulp, for example.

2. Description of the Prior Art

A double cylinder press of this type is disclosed in Japanese Patent No. 885078 (Japanese Patent Publication No. 52-10741). The prior art double cylinder press comprises a pair of box-shaped stationary butt and swing butt which are disposed side by side with the opposed sides thereof opened entirely to communicate with each other and which are provided therein one each with cage cylinders covered at the outer circumferences thereof with wire gauzes and rotatably supported by shafts. The swing butt has a construction such that it can longitudinally be swung relative to the stationary butt with a pivot portion formed on the lower portion of the opposed openings as a fulcrum by means of a hydraulic cylinder. The opposed open edges of the two butts, excluding the uppermost open edges, are stretchably joined with each other through a flexible member of rubber cloth, plastic cloth or the like material. With the double cylinder press herein described, fibrous layers of a prescribed thickness can be formed on the surfaces of the respective wire gauzes by longitudinally swinging the swing butt by means of the hydraulic cylinder to thereby adjust the distance between the swing butt and the stationary butt in a region in which the cage cylinders of the two butts are to be brought into pressure contact with each other, then rotating the cage cylinders in prescribed directions, thereby allowing fibers to be extracted from both fiber-containing liquid stored in advance in the butts and fresh fiber-containing liquid supplied from feed pipes and to be adsorbed on the surfaces of the wire gauzes, and causing the fibers on the wire gauzes to butt against each other in the aforementioned region to be compressed and dehydrated.

With the prior art double cylinder press, however, as the stationary butt and swing butt assume a box shape and therefore since the flat shape of the lower portions of the two butts does not match with the circumferential shape of the cage cylinders, fresh fiber-containing liquid, even when supplied continuously to the lower portions of the butts via the feed pipes, is prevented from being guided in the directions of rotation of the cage cylinders and is mixed with the liquid of low fiber contents stored in advance in the butts to be diluted, with the result that the efficiency of adsorption of the fibers in the liquid onto the wire gauzes is considerably lowered.

Since each of the cage cylinders within the butts has its entire length set substantially in the same diameter and is supported by a shaft in a state wherein the opposite end surfaces of the cage cylinder and the corresponding inner wall surfaces of the butt have seal members interposed therebetween, fibers which have peeled off the wire gauzes of the cage cylinders in the course of the formation of the fibrous layers, for example, become a mass having a diameter of about 1 cm and remain above the region in which the cage cylinders come into pressure contact with each other. Since the mass has its escape cut off by the inner wall surfaces of the butts kept in contact with the opposite end surfaces of the cage cylinders and moves above the aforementioned region in a floating state, there is a fair possibility of the surfaces of the wire gauzes being damaged. Further, it is necessary to stop the operation of the apparatus as a whole in removing the mass. Thus, the prior art double cylinder press entails the disadvantages in that the production efficiency is lowered due to the formation of a mass of fibers and that troublesome manual work for removing the mass is inevitably required.

Furthermore, the prior art double cylinder press has a construction such that waste liquid resulting from the compression and dehydration of the fibers by means of the cage cylinders is allowed to drop down through the wire gauzes and discharged out of the apparatus via discharge ports formed in the lower portions of the butts. Actually, however, the waste liquid is not guided downwardly, but is scattered outwardly by the rotation of the cage cylinders to induce a phenomenon of the waste liquid being absorbed again in the fibrous layers once formed. This makes the complete dehydration treatment impossible and results in breakage of the formed fibrous layers.

OBJECT AND SUMMARY OF THE INVENTION

The main object of the present invention is to provide a double cylinder press for the formation of fibrous layers, which is capable of efficiently guiding fresh fiber-containing liquid supplied to the lower portions of butts from feed pipes in the direction in which cage cylinders are rotated, causing the fibers in the liquid to be completely adsorbed on the surfaces of wire gauzes, effectively removing a mass into which fibers peeled off the surfaces of the wire gauzes are possibly formed in the course of the formation of fibrous layers and which remains above the region in which the cage cylinders come into pressure contact with each other, and allowing waste liquid resulting from the compression and dehydration of the fibers by means of the cage cylinders to efficiently drop down to enhance the ability of dehydration treatment and prevent the formed fibrous layers from being broken.

To attain the object described above according to the present invention, there is provided a double cylinder press for the formation of fibrous layers, which comprises a stationary butt and a swing butt having curved lower portions and having openings opposed to each other, cage cylinders supported one each within the butts by a shaft, covered at their peripheries with wire gauzes and formed at their respective opposite end portions into small diameter portions compared with the portions covered with the wire gauzes to define mass-collecting compartments between the adjacent small-diameter portions of the cage cylinders, the curved lower portions of the butts matching in shape with the cage cylinders, a flexible member having its one part fixed to the side edges of the openings to assume a "U" shape projected outwardly and its other part fixed to the lower edges of the openings to assume an inverted "U" shape projected inwardly, for joining the open edges of the butts with each other, and a plurality of inclined drain plates extending in the lengthwise direction of the cage cylinders and disposed on the inner circumferences of the cage cylinders at regular intervals.

The main object and other objects, characteristic features and advantages of the present invention will become apparent from the further description to be made hereinbelow with reference to the accompanying drawings.

DESCRIPTION OF THE PREFERRED EMBODIMENTS

Figure 1:
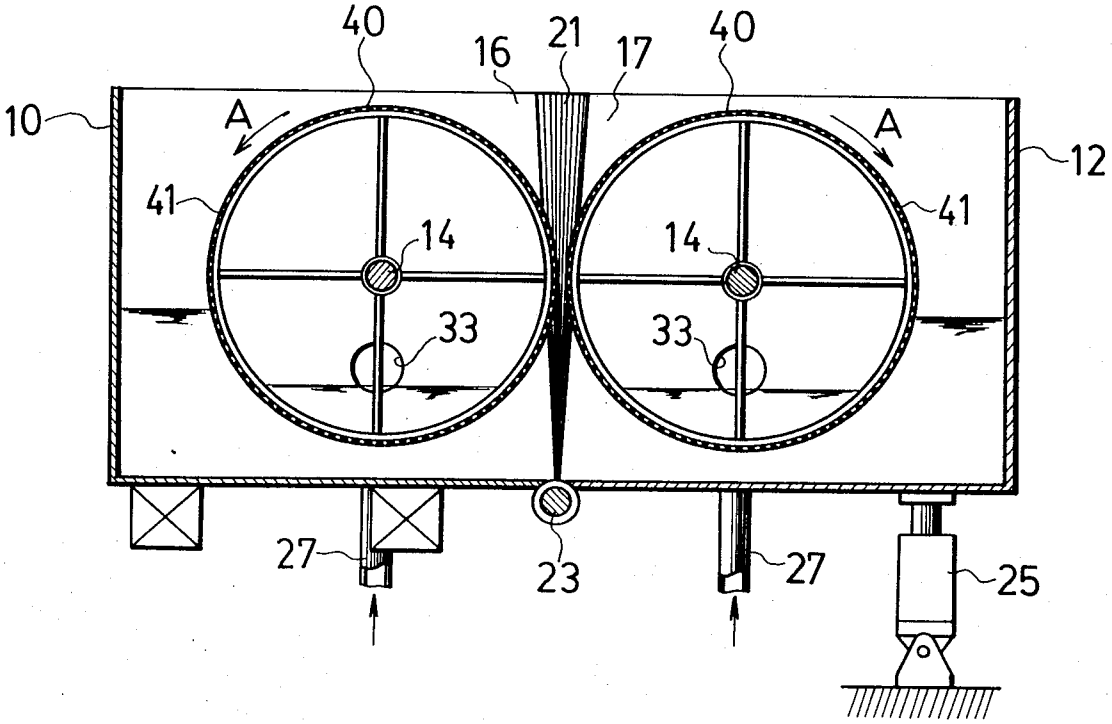
PRIOR ART FIG. 1
FIG. 1 is a longitudinally sectioned front view showing a prior art double cylinder press for the formation of fibrous layers.
Figure 2:
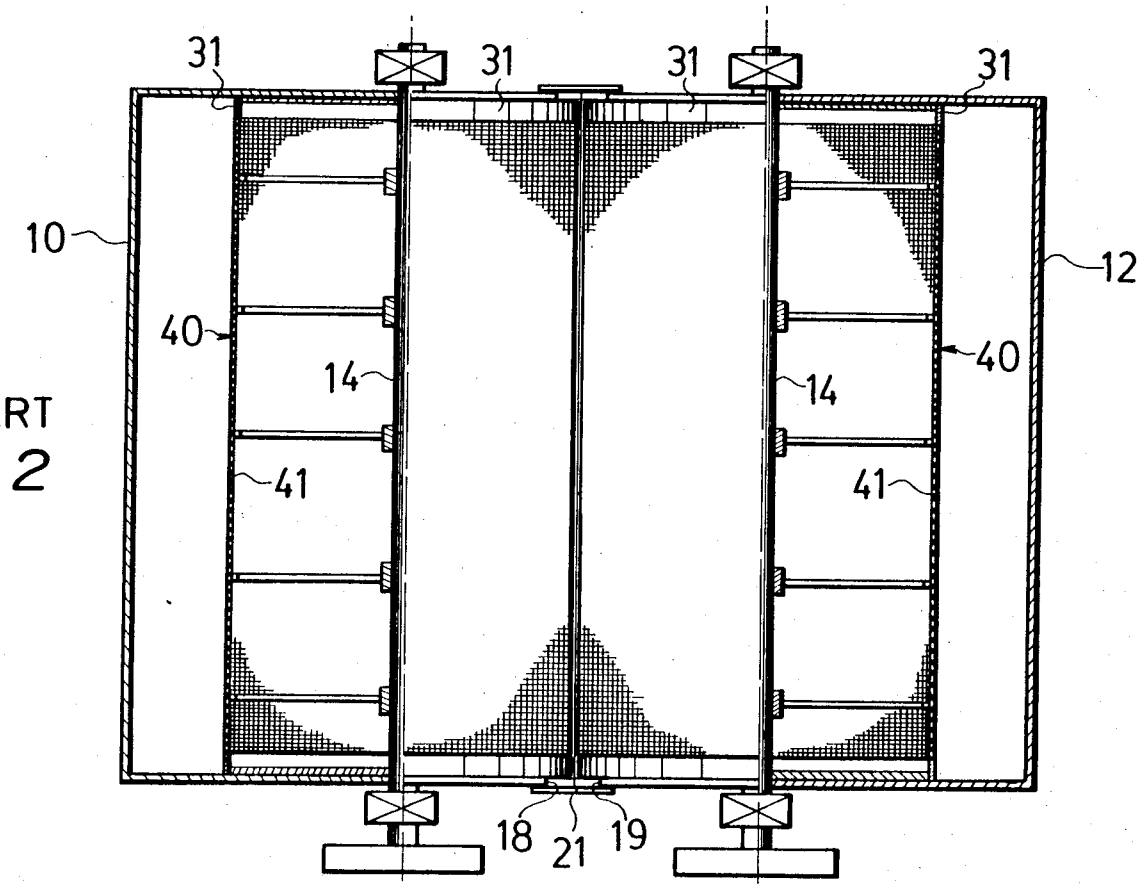
PRIOR ART FIG. 2
FIG. 2 is a laterally sectioned plan view of the prior art double cylinder press.

FIGS. 1 and 2 illustrate a prior art double cylinder press for the formation of fibrous layers, which comprises a pair of box-shaped stationary butt 10 and swing butt 12 disposed side by side with the opposed sides 16 and 17 thereof opened entirely to communicate with each other, and provided therein one each with cage cylinders 40 covered at the outer circumferences thereof with wire gauzes 41 and rotatably supported by shafts 14. The swing butt 12 has a construction such that it may longitudinally swung relative to the stationary butt 10 with a pivot portion 23 formed on the lower portion of the opposed openings 16 and 17 as a fulcrum by means of a hydraulic cylinder 25. The opposed open edges of the two butts, exclusive of the uppermost open edges, are stretchably joined with each other through a flexible member 21 of rubber cloth, plastic cloth or the like material.

The prior art double cylinder press is operated by longitudinally swinging the swing butt 12 by means of the hydraulic cylinder 25 to thereby adjust the distance between the swing butt 12 and the stationary butt 10 in a region in which the cage cylinders 40 of the two butts 10 and 12 are to be brought into pressure contact with each other, then rotating the cage cylinders 40 in the directions shown by arrows A in FIG. 1, thereby allowing fibers to be extracted from both fiber-containing liquid stored in the butts 10 and 12 and fresh fiber-containing liquid supplied to the interiors of the butts via feed pipes 27 and to be adsorbed on the surfaces of the wire gauzes 41 and causing the fibers on the wire gauzes to butt against each other in the aforementioned region to be compressed and dehydrated, thereby forming fibrous layers of a prescribed thickness on the surfaces of the respective wire gauzes.

However, the conventional double cylinder press is disadvantageous in that since the stationary butt 10 and the swing butt 12 assume a box shape as shown in FIG. 1 and therefore since the flat shape of the lower portions of the two butts 10 and 12 does not match with the circumferential shape of the cage cylinders 40, fresh fiber-containing liquid, even when supplied continuously to the lower portions of the butts via the feed pipes 27, is prevented from being guided in the directions of rotation of the cage cylinders and is mixed with the liquid of low fiber contents stored in the butts to be diluted, with the result that the efficiency of adsorption of the fibers in the liquid onto the wire gauzes is considerably lowered.

Since each of the cage cylinders 40 within the butts 10 and 12 has its entire length set substantially in the same diameter and is supported by a shaft in a state wherein the opposite circumferential edge portions of the cage cylinders 40 and the corresponding inner wall surfaces of the butts 10 and 12 have seal members 31 interposed therebetween to assure sealing effect, fibers which have peeled off the wire gauzes 41 of the cage cylinders 40 in the course of the formation of the fibrous layers, for example, become a mass having a diameter of about 1 cm and remain above the region in which the cage cylinders 40 come into pressure contact with each other. Since the mass has its escape cut off by the inner wall surfaces of the butts kept in contact with the opposite end surfaces of the cage cylinders 40 and moves above the aforementioned region in a floating state, there is a fair possibility of the surfaces of the wire gauzes 41 of the cage cylinders 40 being damaged. Further, it is necessary to stop the operation of the apparatus as a whole in removing the mass. Thus, the prior art double cylinder press entails the disadvantages in that the production efficiency is lowered due to the formation of a mass of fibers and that troublesome manual work for removing the mass is inevitably required.

Furthermore, the prior art double cylinder press has a construction such that waste liquid resulting from the compression and dehydration of the fibers by means of the cage cylinders 40 is allowed to drop down through the wire gauzes and discharged out of the apparatus via discharge ports 33 formed in the lower portions of the butts 10 and 12. Actually, however, the waste liquid is not guided downwardly, but is scattered outwardly by the rotation of the cage cylinders to induce a phenomenon that the waste liquid is reabsorbed in the fibrous layers once formed. This makes the complete dehydration treatment impossible and results in breakage of the formed fibrous layers.

The present invention has been accomplished for the purpose of eliminating the aforementioned drawbacks suffered by the conventional apparatus and will now be described with reference to the illustrated embodiments.

Figure 3:
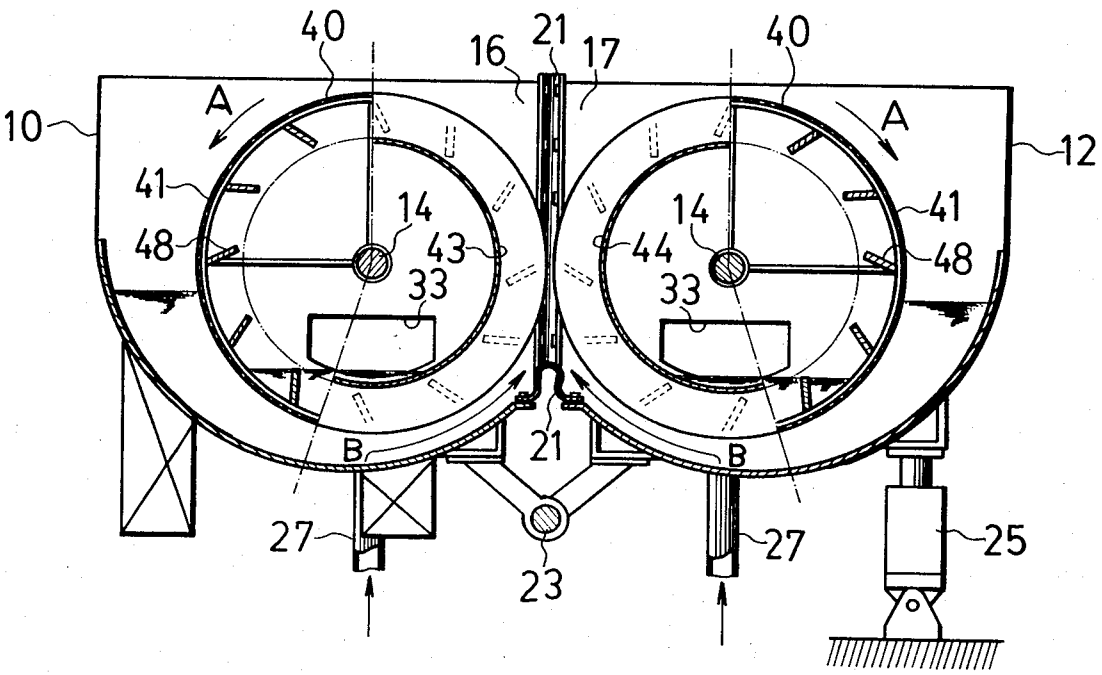
FIG. 3 is a longitudinally sectioned front view showing one embodiment of the double cylinder press for the formation of fibrous layers according to the present invention.
Figure 4:
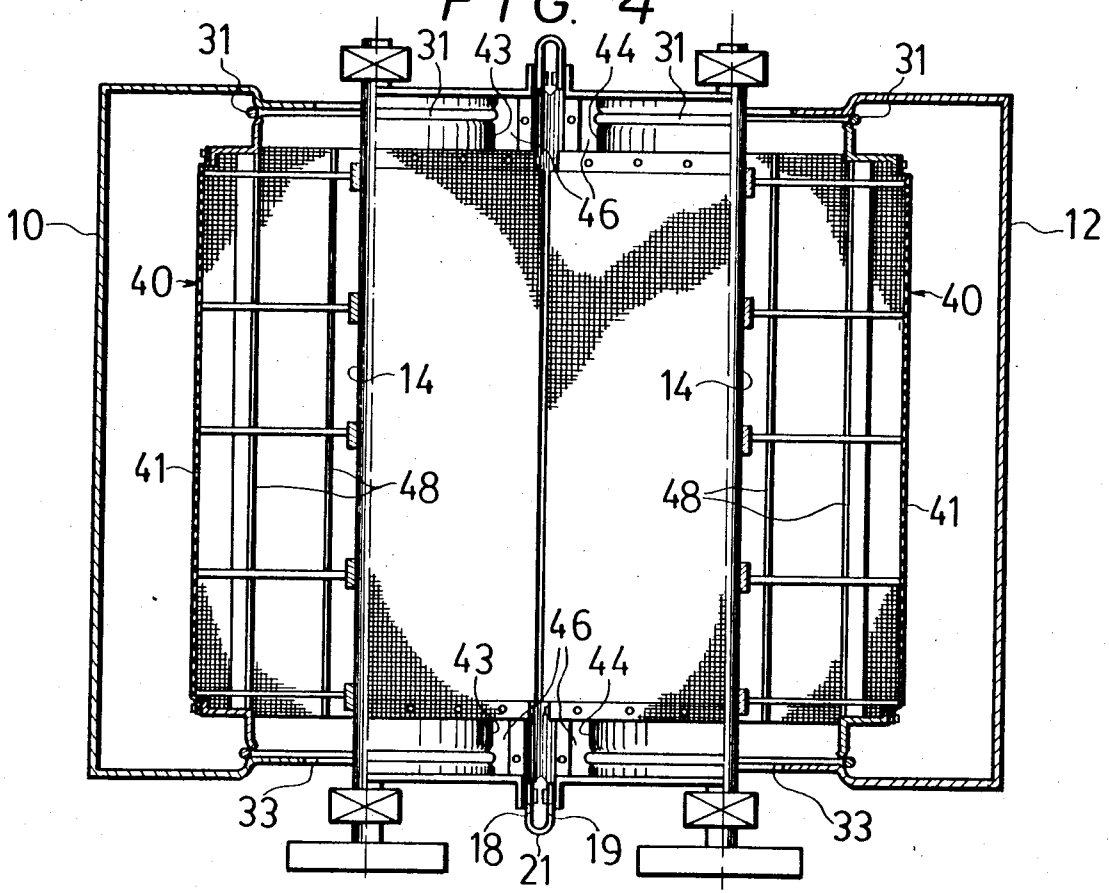
FIG. 4 is a laterally sectioned plan view showing the embodiment.

The first embodiment of the double cylinder press for the formation of fibrous layers according to the present invention shown in FIGS. 3 and 4 comprises, similarly to the conventional double cylinder press, a stationary butt 10 and a swing butt 12 which are disposed side by side with the opposed sides 16 and 17 thereof opened entirely to communicate with each other and which are provided therein one each with cage cylinders 40 covered at the outer circumferences thereof with wire gauzes 41 and rotatably supported by shafts 14, the swing butt 12 having a construction such that it can longitudinally be swung relative to the stationary butt 10 by means of a hydraulic cylinder 25 with a pivot portion 23 as a fulcrum, which pivot portion is disposed below the opposed openings 16 and 17. However, the characteristic features of this embodiment lie in the following.

At first, the stationary butt 10 and the swing butt 12 have their respective lower portions curved along the arc shape assumed by the cage cylinders 40 so that the distance between each of the curved portions of the butts and each of the cage cylinders 40 is gradually decreased toward the opposed openings 16 and 17, whereby fresh fiber-containing liquid supplied continuously from feed pipes 27 to the interiors of the butts can be guided with higher efficiency in the directions in which the cage cylinders 40 are rotated.

Secondly, the respective opposite end portions 43 and 44 of the cage cylinders 40 within the butts 10 and 12 are formed to have a diameter smaller than that of the portions of the cage cylinders covered with the wire gauzes 41 to define mass-collecting compartments 46 between the adjacent small-diameter end portions 43 and 44. Similarly to the illustrated prior art, the cage cylinders 40 of the embodiment are rotatably supported by the shafts 14 in a state wherein seal members 31 are interposed between the circumferential edge portions of the small-diameter end portions defining the mass-collecting compartments 46 therebetween and the corresponding inner wall surfaces of the butts 10 and 12 to fulfill the sealing effect.

Thirdly, a flexible member 21 of rubber cloth or plastic cloth, provided similarly to the conventional apparatus so as to stretchably join the edges of the openings 18 and 19 (excluding the uppermost open edges) with each other, has its part fixed to the side edges of the openings to assume a shape of the letter "U" projected outwardly as illustrated in FIG. 4 and its other part fixed to the lower edges of the openings to assume an inverted "U" shape projected inwardly as illustrated in FIG. 3. Therefore, the part of the flexible member 21 fixed to the lower edges of the openings in particular has its shape cooperating with the curved shape of the lower portions of the butts 10 and 12 to facilitate guidance of the fresh fiber-containing liquid supplied via the feed pipes 27 toward the region in which the cage cylinders 40 are brought into pressure contact with each other.

Fourthly, each of the cage cylinders 40 is provided therein with a plurality of drain plates 48, serving also as reinforcing ribs, which extend in the lengthwise direction of the cage cylinders and disposed aslant at regular intervals, whereby waste liquid resulting from the compression of the fibers in the course of the formation of fibrous layers can efficiently be guided downwardly. To assure this efficiency, the drain plates 48 have their leading ends inclined downwardly relative to the directions of rotation of the cage cylinders 40.

With the apparatus in the first embodiment having the construction as described above, fibrous layers of a prescribed thickness can be formed on the surfaces of the wire gauzes 41 by longitudinally swinging the swing butt 12 by means of the hydraulic cylinder 25 to adjust the distance between the cage cylinders 40 of the stationary and swing butts 10 and 12 in the region in which the cage cylinders 40 are to be brought into pressure contact with each other, then rotating the cage cylinders 40 in the directions shown by arrows A in FIG. 3, thereby extracting fibers both from the fiber-containing liquid already stored in the butts 10 and 12 and from fresh fiber-containing liquid supplied from the feed pipes 27 and allowing the extracted fibers to be adsorbed on the surfaces of the wire gauzes, and causing the cage cylinders 40 to butt against each other in the aforementioned region to effect compression and dehydration. In conjunction with the rotation of the cage cylinders 40, the fresh fiber-containing liquid supplied from the feed pipes 27 is guided with high efficiency in the directions of rotation of the cage cylinders, i.e. in the directions shown by arrows B in FIG. 3, due to coaction of the curved portions of the butts 10 and 12 and the inverted U-shaped flexible member 21 joining the lower edges of the openings with each other, whereafter the fibers contained in the fresh liquid are effectively adsorbed on the surfaces of the wire gauzes 41 of the cage cylinders 40.

The fibers, upon being adsorbed on the gauzes, are subjected to compression and dehydration by means of the cage cylinders 40. In this case, waste liquid resulting from the aforementioned treatments can precisely be guided downwardly by the drain plates 48 provided aslant on the inner circumferences of the cage cylinders 40 and can efficiently be discharged out of the apparatus via discharge ports 33 formed in the lower portions of the butts 10 and 12. Thus, the present embodiment can completely eliminate the conventional adverse phenomenon that the waste liquid is not guided downwardly, but is scattered outwardly by the rotation of the cage cylinders to be re-absorbed in the fibrous layers once formed.

If fibers should peel off the surfaces of the wire gauzes 41 of the cage cylinders 40 to become a mass having a diameter of about 1 cm and remain in the form of the mass above the pressure contact region in the course of the formation of fibrous layers, the mass of fibers drops down spontaneously into the mass-collecting compartments 46 defined between the adjacent end portions 43 and 44 of the cage cylinders 40. According to this embodiment, therefore, there is no fear of the surfaces of the wire gauzes being damaged and it is unnecessary to stop the entire operation of the apparatus in removing the masses of fibers.

Figure 5:
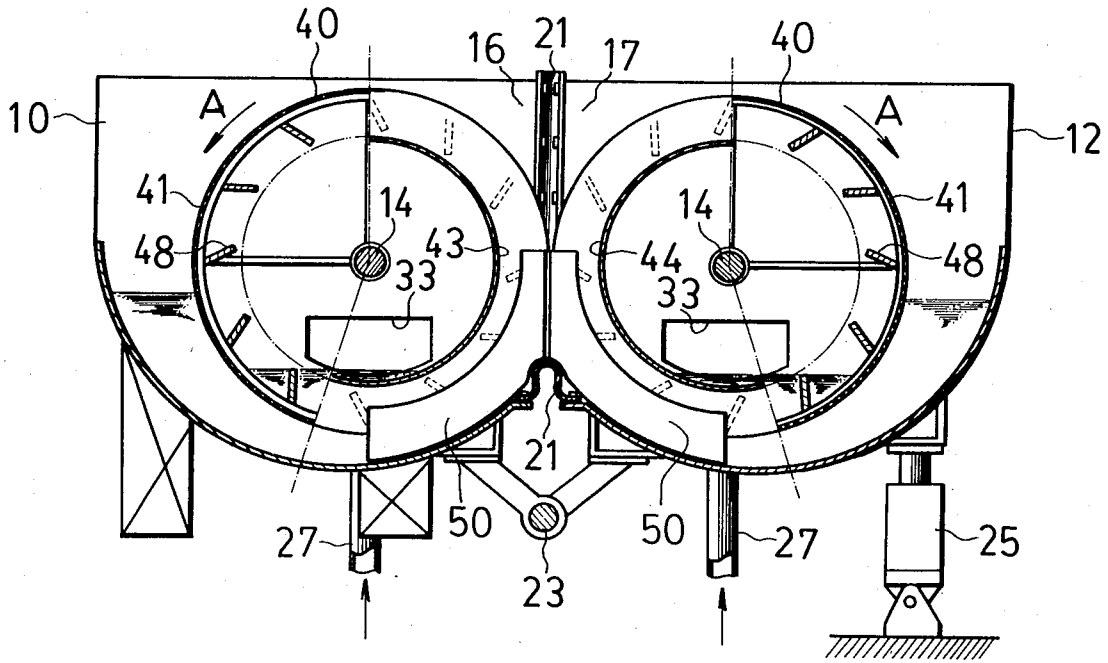
FIG. 5 is a longitudinally sectioned front view showing another embodiment of the double cylinder press for the formation of fibrous layers according to the present invention.
Figure 6:
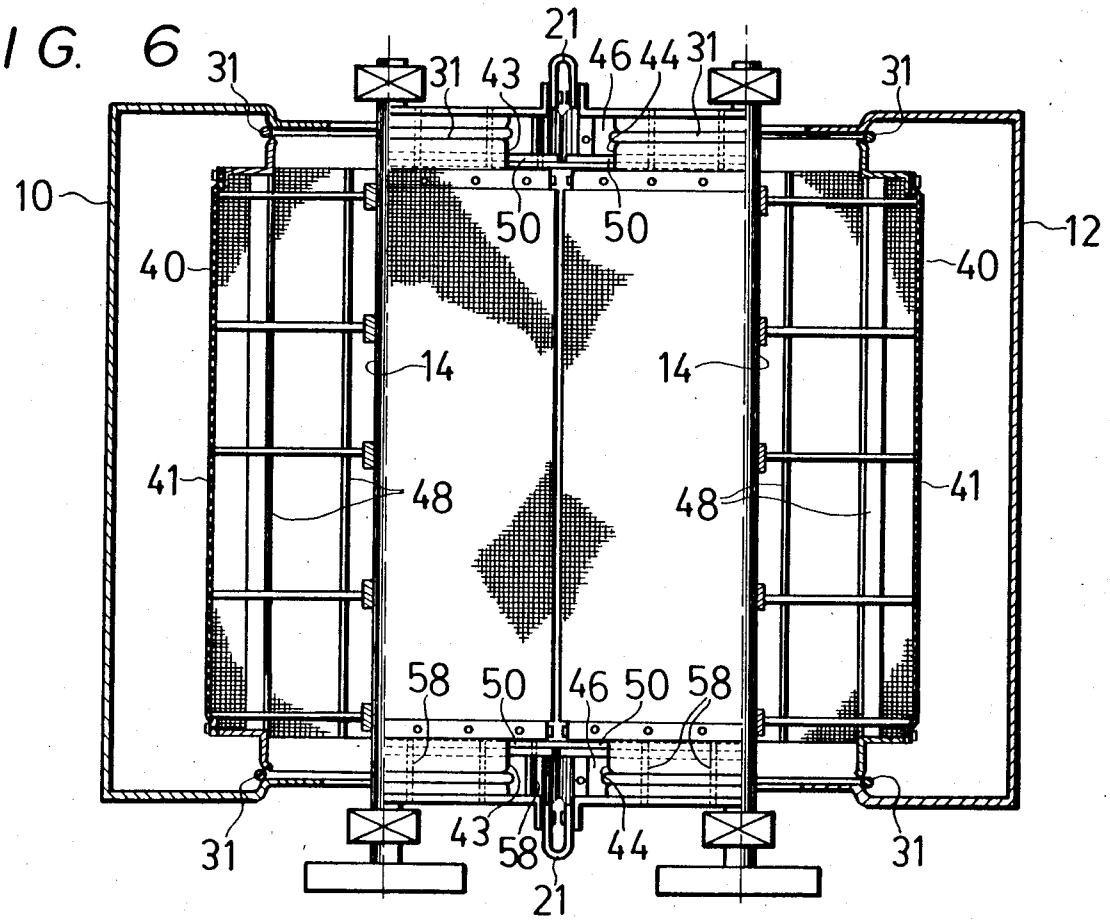
FIG. 6 is a laterally sectioned plan view showing the second embodiment.

FIGS. 5 to 7 show another embodiment of the double cylinder press for the formation of fibrous layers according to the present invention. The same elements as those in the first embodiment are indicated by the same reference numerals as used in FIGS. 3 and 4, and description thereof is omitted in the following. The difference between the first embodiment and the second embodiment is that in view of a possibility that the fiber-containing liquid guided with high efficiency may flow into the mass-collecting compartments 46 defined between the adjacent small-diameter end portions 43 and 44 of the cage cylinders 40 rotatably supported within the butts 10 and 12 by the shafts 14 in the case of the first embodiment, the second embodiment is provided with shield plates 50 which are disposed one each between the lower end surfaces of the portions of the cage cylinders 40 covered with the wire gauzes 41 and the mass-collecting compartments 46 by means of arms 58 fixed to the inner wall surfaces of the butts 10 and 12.

Figure 7B:
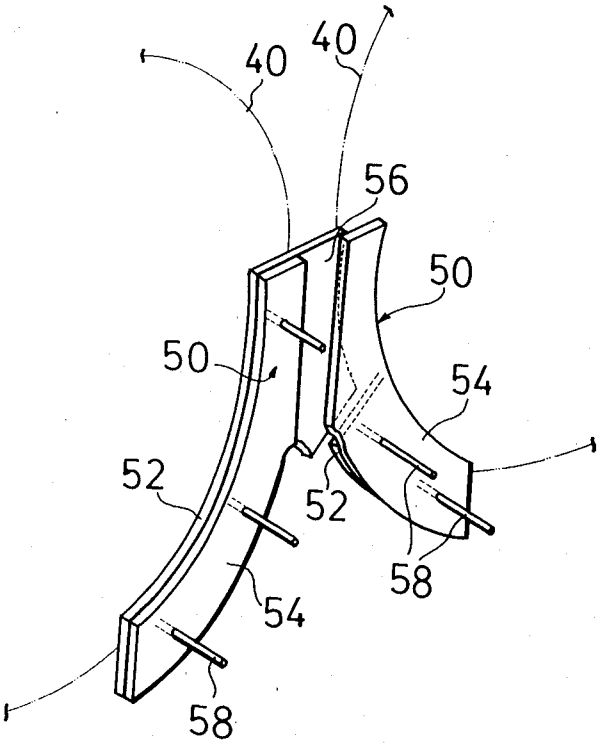
FIGS. 7A and 7B are enlarged perspective views showing the principal part of the second embodiment.
Figure 7A:
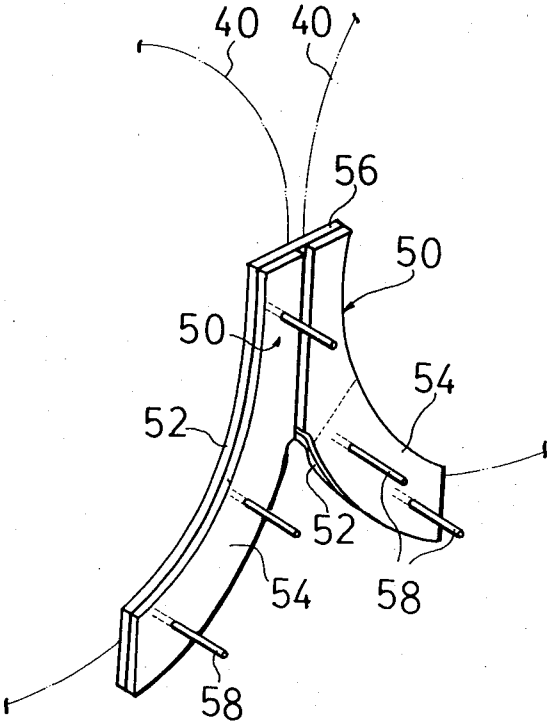

To be specific, each of the shield plates 50 comprises a plastic plate member 52 of low frictional resistance disposed in contact with the lower end surfaces of the portions of the cage cylinders 40 covered with the wire gauzes 41 and a metal plate member 54 stationarily superposed on the plastic plate member 52. The shield plate 50 may optionally be divided into two segments as illustrated in FIGS. 7A and 7B. In this case, the plastic plate member 52 of the shield plate 50 mounted on the stationary butt 10 side is provided integrally with an extension member 56 which extends in the direction of the swing butt 12 side, whereas the plastic plate member 52 of the shield plate 50 mounted on the swing butt 12 side is cut off at the portion thereof corresponding to the extension member 56, so that the metal plate member 54 of the shield plate 50 on the swing butt 12 side can overlap the extension member 56 extending from the stationary butt 10 side at all times even when the swing butt 12 is swung, thereby enabling the mass-collecting compartments 46 and the lower end surfaces of the portions of the cage cylinders 40 covered with the wire gauzes 41 to be continuously shielded completely.

With the second embodiment of the double cylinder press according to the present invention, therefore, the fiber-containing liquid efficiently guided by the coaction of the curved lower portions of the butts 10 and 12 and the inverted U-shaped flexible member 21 for joining the lower edges of the openings is concentrated upon the surfaces of the wire gauzes 41 of the cage cylinders 40 without flowing into the mass-collecting compartments 46 due to the presence of the shield plates 50. As a result, the fibers contained in the liquid are ideally adsorbed on the surfaces of the wire gauzes 41, and the performance of the second embodiment is higher than that of the first embodiment.

What is claimed is:

1. In a double cylinder press for the formation of fibrous layers, comprising a stationary butt and a swing butt which are disposed side by side with the opposed sides thereof opened entirely to communicate with each other and which are provided therein one each with cage cylinders covered at the outer circumferences thereof with wire gauzes and rotatably supported within said stationary butt and said swing butt by means of shafts, said swing butt being capable of being longitudinally swung relative to said stationary butt with a pivot portion formed on the lower portion of the opposed opened sides of said stationary butt and said swing butt as a fulcrum, the edges of said opposed opened sides excluding the uppermost edges of said stationary butt and said swing butt being stretchably joined with each other by means of a flexible member, the improvement wherein:

each of said stationary butt and said swing butt has its lower portion curved along the arc shape of said cage cylinders, said cage cylinders have their respective opposite end portions formed to have a diameter smaller than that of the portions thereof covered with said wire gauzes to define between the adjacent end portions of said cage cylinders compartments for collecting therein masses of fibers formed on the surfaces of said wire gauzes due to a peeling phenomenon, and are provided on the inner circumferences thereof with a plurality of inclined drain plates which are extended in the lengthwise direction of said cage cylinders and disposed at regular intervals, and part of said flexible member joining the side edges of said opposed opened sides of said stationary butt and said swing butt assume a U-shape and other part thereof joining the lower edges of said opposed opened sides assume an inverted U-shape.

2. The improvement according to claim 1, wherein the distance between the curved lower portion of each of said stationary butt and said swing butt and the arc of each of said cage cylinders is gradually decreased toward each of said opposed opened sides.

3. The improvement according to claim 1, wherein said plurality of inclined drain plates have their respective leading ends inclined downwardly relative to the directions of rotation of said cage cylinders.

4. The improvement according to claim 1, further comprising shield plates which are provided one each on the opposite ends of said cage cylinders and attached to said stationary butt and said swing butt for shielding between said compartments and the lower end surfaces of the portions of said cage cylinders covered with said wire gauzes.

5. The improvement according to claim 2, further comprising shield plates which are provided one each on the opposite ends of said cage cylinders and attached to said stationary butt and said swing butt for shielding between said compartments and the lower end surfaces of the portions of said cage cylinders covered with said wire gauzes.

6. The improvement according to claim 3, further comprising shield plates which are provided one each on the opposite ends of said cage cylinders and attached to said stationary butt and said swing butt for shielding between said compartments and the lower end surfaces of the portions of said cage cylinders covered with said wire gauzes.

7. The improvement according to claim 4, wherein each of said shield plates are divided into two segments, one attached to said stationary butt and the other attached to said swing butt, and said one segment has an extension member which overlaps said other segment.

8. The improvement according to claim 5, wherein each of said shield plates are divided into two segments, one attached to said stationary butt and the other attached to said swing butt, and said one segment has an extension member which overlaps said other segment.

9. The improvement according to claim 6, wherein each of said shield plates are divided into two segments, one attached to said stationary butt and the other attached to said swing butt, and said one segment has an extension member which overlaps said other segment.

10. The improvement according to claim 4, wherein each of said shield plates comprises a plastic plate member of low frictional resistance disposed in contact with the lower end surfaces of the portions of said cage cylinders covered with said wire gauzes and a metal plate member stationarily overlapping said plastic plate member.

11. The improvement according to claim 5, wherein each of said shield plates comprises a plastic plate member of low frictional resistance disposed in contact with the lower end surfaces of the portions of said cage cylinders covered with said wire gauzes and a metal plate member stationarily overlapping said plastic plate member.

12. The improvement according to claim 6, wherein each of said shield plates comprises a plastic plate member of low frictional resistance disposed in contact with the lower end surfaces of the portions of said cage cylinders covered with said wire gauzes and a metal plate member stationarily overlapping said plastic plate member.

13. The improvement according to claim 7, wherein each of said shield plates comprises a plastic plate member of low frictional resistance disposed in contact with the lower end surfaces of the portions of said cage cylinders covered with said wire gauzes and a metal plate member stationarily overlapping said plastic plate member.

14. The improvement according to claim 8, wherein each of said shield plates comprises a plastic plate member of low frictional resistance disposed in contact with the lower end surfaces of the portions of said cage cylinders covered with said wire gauzes and a metal plate member stationarily overlapping said plastic plate member.

15. The improvement according to claim 9, wherein each of said shield plates comprises a plastic plate member of low frictional resistance disposed in contact with the lower end surfaces of the portions of said cage cylinders covered with said wire gauzes and a metal plate member stationarily overlapping said plastic plate member.

* * * * *